US006820785B2

(12) United States Patent
Kapiloff

(10) Patent No.: US 6,820,785 B2
(45) Date of Patent: Nov. 23, 2004

(54) ELECTRICAL ROLL PRODUCT DISPENSER

(75) Inventor: David Kapiloff, Gainesville, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 110 days.

(21) Appl. No.: 10/027,785

(22) Filed: Dec. 20, 2001

(65) Prior Publication Data

US 2003/0116003 A1 Jun. 26, 2003

(51) Int. Cl.[7] ..... B26F 3/02; B65H 35/10

(52) U.S. Cl. ..... 225/14; 225/10; 225/72; 225/82; 225/15; 242/564.1; 242/563; 242/564.4; 312/34.8

(58) Field of Search ..... 83/645, 650, 208; 225/10, 14, 15, 67, 82, 89, 91, 51, 47, 12, 72; 242/553, 554, 554.2, 554.5, 562, 563, 563.2, 565, 564, 564.4, 564.1; 312/34.8

(56) References Cited

U.S. PATENT DOCUMENTS

| | | | | |
|---|---|---|---|---|
| 3,715,085 A | * | 2/1973 | Kobayashi et al. | 83/649 |
| 3,730,409 A | | 5/1973 | Ratti | |
| 3,737,087 A | | 6/1973 | Rooklyn | |
| 3,949,918 A | | 4/1976 | Golner et al. | |
| 3,998,308 A | | 12/1976 | Yeakley | |
| 4,666,099 A | * | 5/1987 | Hoffman et al. | 242/564.1 |
| 4,676,131 A | | 6/1987 | Cassia | |
| 4,721,265 A | | 1/1988 | Hawkins | |
| 4,738,176 A | | 4/1988 | Cassia | |
| 4,790,490 A | | 12/1988 | Chakravorty | |
| 4,796,825 A | | 1/1989 | Hawkins | |
| 4,960,248 A | | 10/1990 | Bauer et al. | |
| 5,131,302 A | * | 7/1992 | Watanabe | 83/62 |
| 5,452,832 A | | 9/1995 | Niada | |
| 5,772,291 A | | 6/1998 | Byrd | |
| 6,079,305 A | | 6/2000 | Bloch et al. | |
| 6,105,898 A | | 8/2000 | Byrd et al. | |
| 6,412,655 B1 | * | 7/2002 | Stuetzel et al. | 221/13 |
| 6,412,679 B2 | * | 7/2002 | Formon et al. | 225/14 |

FOREIGN PATENT DOCUMENTS

| | | |
|---|---|---|
| WO | WO 9959457 | 11/1999 |
| WO | WO 0063100 | 10/2000 |

OTHER PUBLICATIONS

EPO Search Report, Nov. 25, 2002.
Co–pending U.S. application No. 10/025,206, filed Dec. 19, 2001.
Notification of Transmittal of International Preliminary Examination Report.

* cited by examiner

*Primary Examiner*—Boyer D. Ashley
(74) *Attorney, Agent, or Firm*—Dority & Manning

(57) ABSTRACT

An electro-mechanical roll towel dispenser includes a housing with a roll carrier disposed therein to rotationally support a roll of towel material. An electro-mechanical feed mechanism is disposed in the housing to dispense measured sheets of the towel material. The feed mechanism operates in a first mechanical operational mode wherein the towel sheets are dispensed by a user grasping and pulling on a tail of the towel material extending from the housing, and a second electrical operational mode wherein a measured length of a next sheet is automatically and electrically fed out of the housing to define the tail for the next user.

13 Claims, 3 Drawing Sheets

ELECTRICAL ROLL PRODUCT DISPENSER

BACKGROUND OF THE INVENTION

The present invention relates to a dispenser for a roll of web material, and particularly to a sanitary dispenser that automatically dispenses a measured amount of material upon a user grasping and pulling the "tail" end of the roll material.

A number of dispensing devices are well known in the art for dispensing and cutting rolls of web material such as paper toweling. With such dispensers, the process of dispensing and cutting the web material is carried out automatically by a user pulling on the free "tail" end of the web material that extends from a dispensing slot in the apparatus. In a typical configuration, the web material is engaged against a rough friction enhancing surface of a feed drum and the action of pulling the web tail causes the drum to rotate. The drum includes a drive mechanism and, after the initial pull on the web tail by a user, the drum is driven a predetermined rotational degree to dispense a metered amount of the material. A cam driven cutting mechanism may be provided in the rotating drum that pivots out of a slot in the drum to automatically cut the web at the proper length. The dispensers typically include a stored energy mechanism, such as an eccentric cam, that is spring loaded during the initial rotation of the feed drum. This device causes the drum to continue to rotate after the web has been cut. This action causes an additional length of the web material to be feed out of the dispensing slot as the tail for the next dispensing sequence. These types of dispensers are commonly referred to as "no-touch" or "sanitary" dispensers because the user does not manually operate any portion of the drive or cutting mechanism and does not actually have to touch the dispenser. The user only touches the tail end of the web material.

Although effective, the conventional mechanical sanitary dispensers utilizing automatic mechanical cutting and feeding mechanisms can be relatively complicated from a mechanical component standpoint and expensive to manufacture and maintain. Also, some users have noted that such dispensers present an inordinate amount of resistance to pulling a towel from the dispenser. This may be particularly true when the initial pulling action by the user also provides the force needed to load a spring of the automatic tail feeding mechanism. Thus, web materials with relatively high tensile strength must be used with such dispensers.

Advances have been made in the art relating to electronic sanitary towel dispensers. With such dispensers, the unit is typically activated upon detection of motion of a user's arm or hand. A motor is subsequently energized through a control circuit and power source to drive a feed roll and thus dispense a measured length of material. The user then grabs the exposed material and pulls it at some angle to the dispenser cover causing the sheet of material to separate on a cutting edge or serrated tear bar. The cycle is repeated for the next user.

U.S. Pat. No. 3,730,409 discloses an electronic dispenser wherein initially a full measured length of towel hangs out of the dispenser. A user grabs and separates the towel by pulling it against a tear bar. A force activated switch is configured with the tear bar that activates a dispenser motor through a power source and electronic circuit upon the user tearing the towel. The motor then drives a feed roll to deliver a full measured length of towel material outside of the dispenser cabinet where it hangs for the next user to grab and tear. WO 00/63100 describes an electronic dispenser with a similar operating principle. These dispensers have the disadvantage that the entire towel sheet hangs out of the dispenser prior to use. This is obviously not a sanitary or desirable condition.

A drawback with conventional electronic dispensers is that they operate using an active sensor to trigger the dispensing sequence. The different types of sensors vary in their method of operation, but all generally operate on the principle that the presence of the user triggers the dispenser without the user touching the dispenser. The sensor may detect body motion, infrared heat, or some other physical attribute of the user. Regardless of how they operate, such sensors are always "on" and thus continuously draw current from the power source. This greatly reduces the battery life of such systems resulting in frequent battery replacement and maintenance.

Another drawback to conventional electronic dispensers is performance reliability. The systems are prone to false "trips" due to temperature variations, consumer traffic and movement, stray RF signals, etc., resulting in the dispensing of sheets when no bona fide user has actually attempted to activate the dispenser. These false trips waste paper, drain the system batteries, and frustrate patrons.

The present invention relates to an electrical sanitary dispenser that addresses at least some of the drawbacks of conventional mechanical and electrical dispensers.

SUMMARY

Objects and advantages of the invention will be set forth in part in the following description, or may be obvious from the description, or may be learned through practice of the invention.

The present invention provides an electronic dispenser for dispensing measured sheets from a roll of web material. The dispenser is not limited to dispensing any particular type of rolled web material, but is particularly useful for dispensing measured sheets of towel material and will be referred to and illustrated herein as a towel dispenser for ease of explanation. The dispenser is a "sanitary" or "no-touch" dispenser in that the user only touches the tail of the material extending out of the dispenser to dispense a measured sheet and need not activate or manually manipulate a dispensing mechanism or any portion of the dispenser during normal use.

The dispenser includes a housing of any shape, configuration, or aesthetic appearance. A roll carrier is disposed in the housing for rotationally carrying a roll of the web material. A dispensing slot is defined in the housing through which measured lengths of the web material are dispensed. A length of the web material extends out of the dispensing slot and defines a "tail" that a user grasps and pulls in order to start the automatic dispensing sequence.

An electrically driven feed mechanism is disposed in the housing to dispense the sheets of web material therefrom. An electric motor is configured for driving the feed mechanism. A power source, such as a battery or external power circuit, is provided to power the motor and associated circuitry.

In one particular embodiment, the feed mechanism includes a driven feed roller mechanically engaged by the motor. A pressure roller may be disposed against the driven feed roller so as to define a nip through which the web material passes in its running path through the dispenser.

A sensor is disposed within the housing at a location along the running path of the web material. This sensor is positioned and configured to detect a parameter within the housing that changes or varies as a result of a user grasping and exerting an initial pulling force on the web tail extending out of the dispensing slot. The "parameter" sensed may be any number of features or variables. For example, in one embodiment, the sensor is a contact type sensor against which the web material presses in its running path. In a static or dormant mode, such as when the tail is simply hanging from the dispenser, the web material does not move and very little force is exerted by the material against the sensor. However, upon a user grasping and pulling on the web tail, the material within the dispenser is drawn taunt and/or its path is changed or otherwise deviated. The sensor may be deflected by the change in the web material or simply detect the change in the web path resulting in activation of the automatic dispense sequence.

In an alternate embodiment, the sensor need not be in contact with the web material. For example, the sensor may be a motion type of sensor that directly or indirectly detects movement of the web material upon a user initially pulling on the web tail. In one particular embodiment, the sensor may detect rotational movement of a roll or like member that is caused to rotate by the user pulling on the tail.

Regardless of the type of sensor or sensed parameter, the sensor has a dormant mode in which it is not supplied with power from the power source. In other words, the sensor is not always "on," but is only activated upon an initial pull on the tail material. Thus, the sensor is not a drain on the power supply.

A control circuit may be provided to coordinate operation of the various components. For example, a circuit may be in communication with the power supply, motor, and sensor. Activation of the sensor may cause a contact in the control circuitry to close wherein power is then supplied to the motor to dispense a length of the web material. A relatively simple timing circuit may be provided that controls the operating time of the motor. Thus, the length of web material dispensed is controlled by the run time of the motor. There are numerous other methods available to those skilled in the art to control the length of web material dispensed by the feed mechanism.

The dispenser is further provided with a web cutting or severing device to enable the user to cut the dispensed length of web material into an individual sheet. Various suitable automatic and manual cutting devices are known in the art and may be used with the present dispenser for this purpose. For example, the automatic dispensing sequence may include an automatic cutting sequence as well. However, in order to conserve battery power and minimize complexity and manufacturing costs, it may be desired to utilize a relatively simple manual cutting device, such as a tear bar (blade) disposed proximate to the dispensing slot. To sever the web material, the user simply pulls the material at an angle against the tear bar.

After the web has been severed, provision should be made that a tail is presented for the next user. In this regard, the dispenser may include a cutting sensor disposed to detect the manual web cutting sequence and to generate a corresponding signal causing the feed mechanism to subsequently dispense a second measured length of the web material from the dispensing slot to define the tail for the next user. In one particular embodiment, the web cutting sensor may be a tear bar sensor disposed to detect movement or deflection of the tear bar upon the user pulling the web material against the bar. In another embodiment, a sensor may be deployed to detect deflection or movement of the web material as it is pulled against the tear bar by the user. This sensor may be the same sensor used to detect the initial pull on the tail by user, or a different sensor.

The invention will be described in greater detail below by reference to embodiments thereof illustrated in the figures.

DETAILED DESCRIPTION

Figure 1:
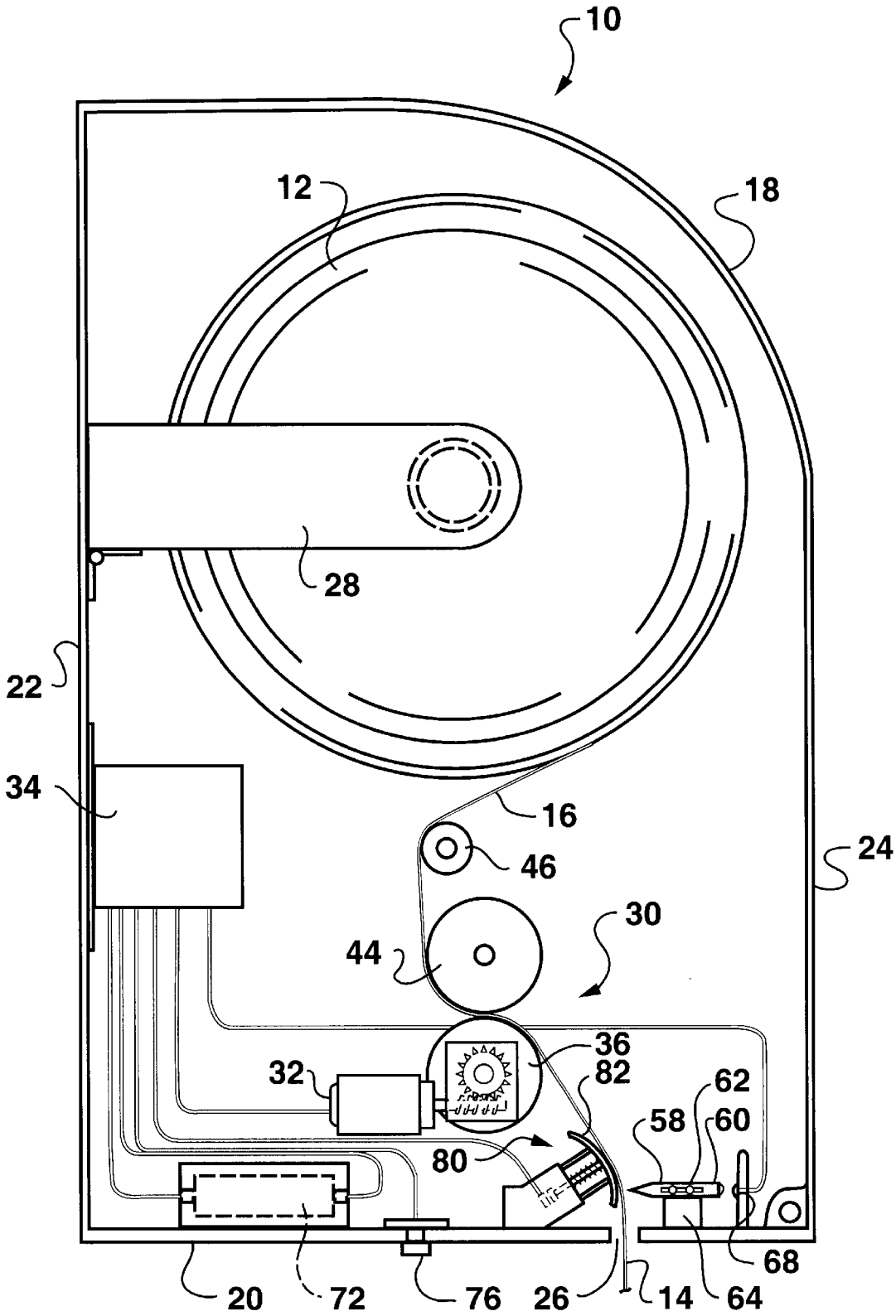
FIG. 1 is cross-sectional diagrammatic view of an embodiment of a dispenser according to the invention.

Reference will now be made in detail to embodiments of the present invention, examples of which are illustrated in the Figs. Each embodiment is provided by way of explanation of the invention, at not meant as a limitation of the invention. For example, features illustrated or described as part of one embodiment may be used with another embodiment to yield still a further embodiment. It is intended that the present invention include these and other modifications and variations coming within the scope and spirit of the invention.

Embodiments of a dispenser 10 incorporating basic operational features according to the present invention are illustrated in the figures. The dispenser 10 is configured to dispense a primary roll 12 of web material 16 that may be, for example, a standard eight-inch towel roll. For illustrative purposes only, the roll 12 will be referred to as a towel roll and the web material will be referred to as towel material.

The dispenser 10 includes a housing 18 of any general shape and configuration. The housing 18 includes a bottom portion 20, a front portion 24, and a back portion 22. The dispenser 10 may be mounted to a vertical supporting wall structure by any conventional means. A dispensing slot 26 is defined at an appropriate location in the housing 18. In the illustrated embodiment, the dispensing slot 26 is provided in the bottom portion 20. It should be understood that the dispensing slot 26 may be disposed at various locations in the housing depending on the conveying path of the towel material 16 and configuration of the internal components of the dispenser 10. The dispensing slot is disposed so that a user can see a tail 14 of the towel material extending therefrom and has easy access to grasp and pull the tail 14.

It should be appreciated that the dispenser 10 according to the invention is not limited in its construction by any particular type of materials. For example, the back portion 22 and/or bottom portion 20 may be formed as a sheet metal assembly and the front portion 24 may comprise a removable or pivotal plastic assembly.

The roll 12 is rotatably disposed in the housing 18 by any manner of suitable carrier, such as the side arms 28 disclosed in FIG. 1. Various configurations of carrier mechanisms are know in the art for rotatably supporting a roll of material in a dispenser, and any such device may be used with the present invention.

The dispenser 10 incorporates an electrical feed mechanism, generally 30. The towel material 16 passes through the feed mechanism 30 in its running path through the dispenser housing 18. As will be described in greater detail herein, the feed mechanism 30 is activated to dispense a measured length of the towel material 16 from the dispensing slot 26 upon a user simply grasping and pulling on the tail 14 extending from the dispensing slot 26. After the material has been severed into an individual sheet by the user pulling it against the tear bar 58, the feed mechanism 30 automatically dispenses a second measured length of the towel material out of the dispensing slot 26. This second measured length of material becomes the tail 14 of the next sheet to be pulled by a user.

In the illustrated embodiment of the dispenser 10, the feed mechanism 30 includes a feed roller 36 rotatably mounted in the housing 18 by any conventional mounting mechanism. The feed roller 36 is drivingly engaged by an electrically powered motor 32. The feed roller 36 may be engaged by the motor by any one of a number of conventional devices. For example, the feed roller 36 may be directly geared to the output shaft of the motor 32, as illustrated in the figures. In an alternate embodiment, a clutch mechanism may be operably disposed between the motor 32 and the feed roller 36. In an alternate embodiment, the motor 32 may drive a friction roll that is engaged against and thus rotates the feed roller 36. It should be appreciated that any means of transferring power from the drive motor 32 to the feed roller 36 is within the scope and spirit of the invention.

In the illustrated embodiment, a pressure roller 44 is disposed in opposition to the feed roller 36 and defines a nip with the feed roller 36 through which the towel material 16 passes, as illustrated in the figures. Any number and configuration of deflection rollers 46 may be used to direct the path of the towel material 16 within the housing 18. The pressure roller 44 ensures that the towel material is frictionally engaged against the surface of the feed roller 36 so that rotation of the feed roller 36 causes the towel material 16 to be dispensed from the dispenser.

Upon delivery of a measured length of towel material from the dispenser 10, the feed mechanism stops its operation thus preventing slippage of the material 16 while the user tears or severs the measured sheet from the roll. A tear blade or bar 58 may be disposed within the housing 18 proximate to the dispensing slot 26 so that, once the desired length of towel material 16 has been dispensed, the user can sever the measured length of towel material into a sheet by pulling the towel forward and across the tear bar 58.

The dispenser 10 includes a sensor, generally 80, disposed within the housing at a location along the running path of the towel material 16. The sensor 80 is positioned and configured to detect a parameter that changes or varies as a result of a user grasping and exerting an initial pulling force on the web tail 14 extending out of the dispensing slot 26. The "parameter" sensed may be any number of features or variables. For example, in the embodiments illustrated in the figures, the sensor 80 is an electrical contact sensor having a spring-loaded contact surface 82 against which the towel material 16 presses in its running path. In a static or dormant mode, such as when the tail 14 is simply hanging from the dispenser, the towel material 16 does not move and very little force or pressure is exerted by the material against the contact surface 82. However, upon a user grasping and pulling on the tail 14, the towel material 16 within the dispenser is drawn taunt and/or its path is changed or otherwise deviated. The movement or force exerted by the towel material 16 causes deflection of the spring loaded contact surface 82 sufficient for closing contacts within the electrical sensor 80. This results in a signal being sent from the sensor 80 to a control circuit or circuitry 34 causing the motor 32 to energized.

The resistance of the contact surface 82 is desirably calibrated so that a "substantial" force on the tail 14 corresponding to that exerted by a user to pull a sheet of material from the dispenser is required to activate the sensor. The sensor 80 should be calibrated so that superfluous movement of the tail 14 does not activate the sensor.

It should be appreciated that the location of the sensor 80 may vary anywhere along the paper path within the housing 18 or external to the housing so long as it is disposed to sense a change in the force or direction of the towel material in its running path.

Figure 3:
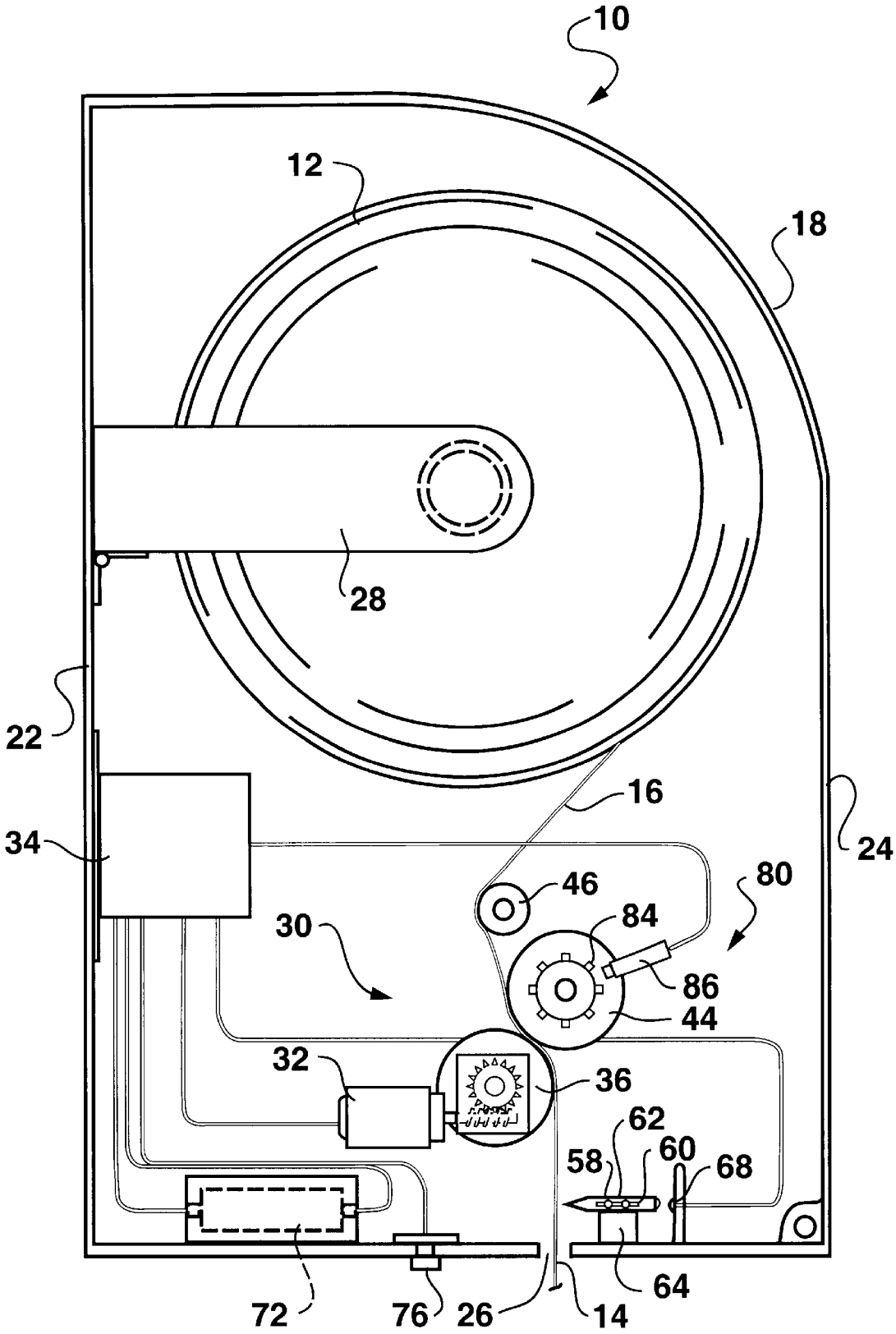
FIG. 3 is a cross-sectional diagrammatic view of still another embodiment of a dispenser according to the invention.

The sensor 80 may also be of a type that indirectly senses movement of the towel material upon a user pulling on the tail 14. For example, the sensor may detect a parameter or state of a component that is changed as a result of movement of the towel material within the housing One example of such an embodiment is illustrated in FIG. 3. The sensor 80 is this embodiment detects rotational movement of a component within the housing 18 resulting from the user pulling on the tail 14. For example, in the illustrated embodiment, the sensor 80 is disposed to detect rotational movement of the pressure roller 44. Any number of conventional revolution counters or similar devices are available for this purpose, such as a simple tacho-generator. For example, the roller 44 may include a vane or vanes 84 disposed at an end thereof. Revolutions of the vanes 84 are detected and counted by a counter 86. Upon sufficient rotational movement of the roller 44 being "counted" by the counter 86, a signal is sent to the control circuit 34 causing the motor 32 to be energized. It should be appreciated that the gearing between the motor 32 and feed roller 36 should be of the type that allows at least some degree of rotation of the feed roller 36 upon a user grasping and pulling on the tail 14.

It should be understood that a revolution counter could be used to detect rotational movement of any roller or component within the housing 18, including the feed roller 36, deflection roller 46, material roll 12, and the like.

It should be appreciated that the sensor 80 is not energized in a dormant or static mode of the dispenser 10. The sensor 80 is "force activated" by the action of a user grasping and pulling on the tail 14. Once the sensor 80 is triggered, the control circuit 34 causes power from a power source 72 to be supplied to the motor 32 to automatically drive the feed mechanism 30 (the feed roller 36 in the illustrated embodiment). The motor is energized a sufficient time for a desired length of towel material 16 to be dispensed out of the dispensing slot 26. This "time" may be controlled in a number of ways. For example, the control circuit 34 may include a simple timing circuit for this purpose. In the embodiment of FIG. 3, the amount of material 16 dispensed can be determined by the revolutions of the pressure roller 44 as detected by the counter 86. Upon a sufficient number of revolutions of the roller 44 being detected by the counter 86, the circuit 34 de-energizes the motor 32. It is well within the level of those skilled in the basic electronic arts to devise any number of suitable control systems for operation of the motor 32.

It should be appreciated that the term "control circuit" is used herein to broadly define any combination of relays, switches, power sources, counters, sensors, integrated circuit boards, and the like that route the various signals and actuate the various components of the dispenser 10 in the desired sequence.

In an alternative embodiment, a mechanical measuring system may be utilized. One such system widely known and used in the art is a gear system wherein the length of the sheet is determined by the arc of a curved rack that is geared to a metering roll. Such a system is used, for example in the LEV-R-MATIC® roll towel dispenser from Kimberly-Clark Corporation. This system utilizes a metering roll with a fixed ring gear on an end thereof that is geared to a curved rack gear by way of a floating pinion gear. The ring gear could be provided on the feed roller 36 or pressure roller 44 in the present dispenser. As the towel material 16 is dispensed, the metering roll rotates and drives the curved rack gear by way of the pinion gear. The length of the sheet is determined by the degree of travel of the curved rack gear. At the stop position of the curved rack gear, the feed roller 36 would be locked and the sheet material clamped thereby. The pinion gear is housed in an angled track and moves within the track to disengage from the ring gear and curved rack gear at the stop position of the rack gear, at which point the rack gear falls back to its start position. This type of system is well known by those skilled in the art and need not be described in great detail herein.

As mentioned, once the sheet of material has been severed by the user, a second measured length of the towel material 16 is automatically dispensed to define a tail 14 for the next user. This sequence may be accomplished in various ways including activation of the tail pull sensor 80 or a different sensor. For example, a web cutting sensor may be used to detect a parameter or condition indicating that the user has severed the dispensed sheet of material. An example of this type of configuration is shown with the embodiments of FIGS. 1 and 3. The tear blade 58 "floats" on a carrier 64 to a certain degree so that the blade 58 is caused to move or deflect upon the user pulling the towel material 16 against the blade 58. In the illustrated embodiment, the blade 58 includes an elongated slot 62 engaged by protrusions 60 on the carrier 64. The tear bar 58 thus floats to the extent permitted by engagement of the protrusions within the slot. A sensor, generally 68, detects motion or deflection of the tear bar 58 and sends a corresponding signal to the control circuit 34. In the illustrated embodiment, the sensor 68 is a relatively simple contact arrangement between a stationary contact and the end of the tear blade 58. The signal from the tear blade sensor 68 acts as a trigger signal to energize the motor 32 in order to feed a measured length of the towel material 16 out of the dispensing slot 26. Again, various means may be employed to control the length of the tail 14, including a timing circuit, revolution counter, and so forth.

Figure 2:
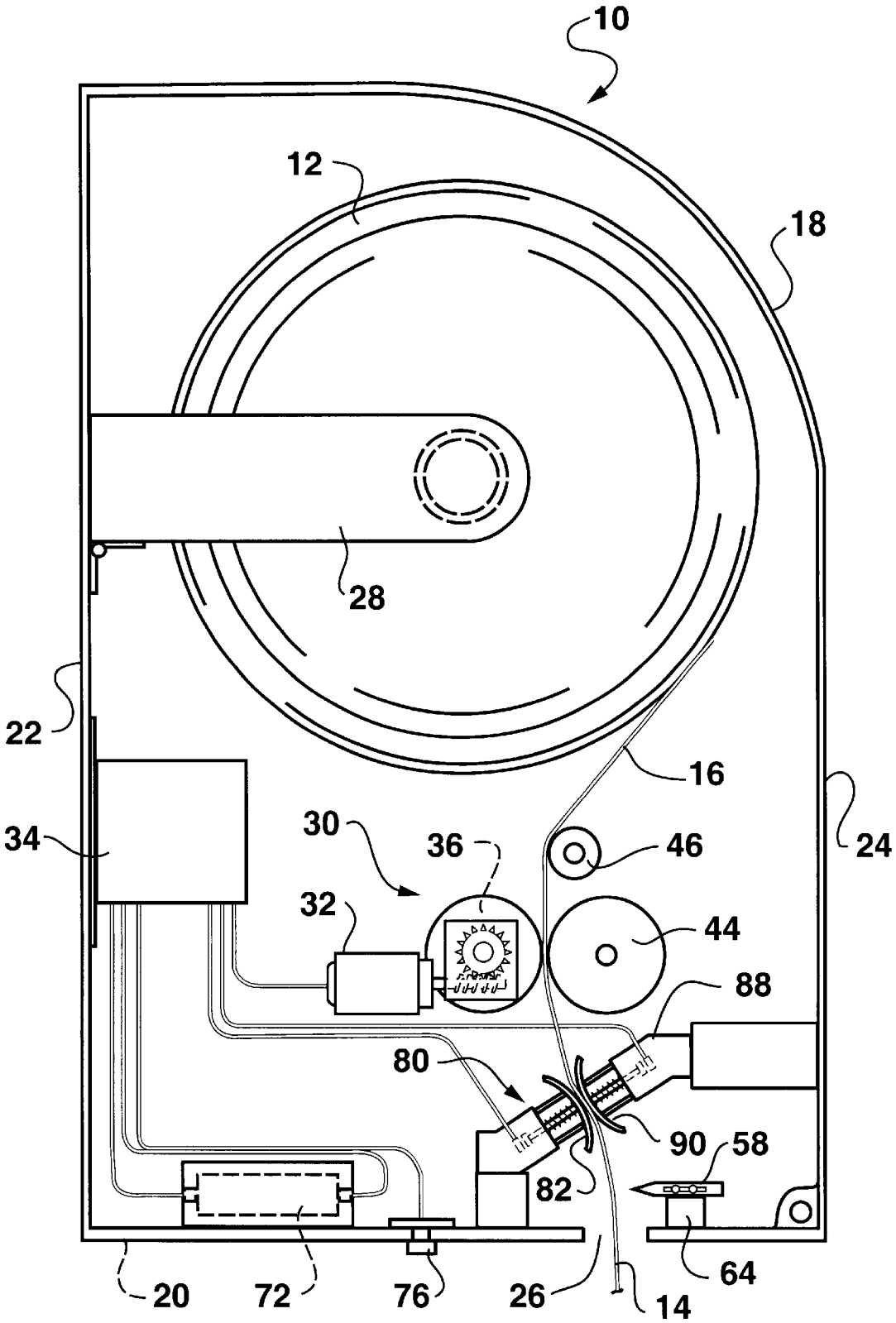
FIG. 2 is a cross-sectional diagrammatic view of an alternate embodiment of a dispenser according to the invention.

In the embodiment of FIG. 2, a web cutting sensor is provided by way of a second electrical contact sensor 88 having a spring loaded contact surface 90 disposed generally opposite to the contact surface 82 used to detect the initial tail pull. It can be seen that, in order to pull the material 16 against and across the tear blade 58, the user must pull the material forward against the contact surface 90. This results in a deflection of contact surface 90 sufficient to close a contact within the sensor 88 whereby a signal is sent to the control circuit 34 to energize the motor 32. It should be appreciated that the sensor 88 can be disposed at any suitable location to detect movement or change in the pressure of the towel material as a result of the user pulling the material against the tear blade 58.

In an alternate embodiment, a single sensor (such as sensor 80) can be configured to detect movement or force on the web material 16 upon the initial tail pull that starts the dispensing sequence and the tearing or severing operation to initiate the tail feed sequence.

As mentioned, a power supply 72 is contained within the housing 18 to power the various electronic components and control circuit 34. The power source 72 may include a battery compartment for disposable DC batteries. Although not shown in the figures, an AC to DC adapter may be utilized to provide an alternate source of power to the dispenser 10. This embodiment may be particularly useful wherein the dispenser 10 is mounted in close proximity to an AC outlet.

An emergency feed button 76 may also be provided with the dispenser 10 as a way for a technician or maintenance person to bypass the circuitry and energize the motor 32 for driving a length of the towel material from the dispenser. This may be necessary, for example, when the tail 14 has become jammed within the dispenser and does not extend out of the dispensing slot 26.

The dispenser 10 may also incorporate a device to indicate to a user or technician that power is available to the dispenser. This device may be a relatively simple light or LED display that is illuminated so long as power is available. Any number or suitable indicators may be used in this regard.

It should also be appreciated that a dispenser 10 according to the invention may incorporate any combination of additional features found on conventional hands-free dispensers. For example, the dispenser may include an emergency manual feed device such as a manual hand wheel or knob. The dispenser may be configured to dispense a stub roll in addition to a primary roll. Any combination of such additional features is within the scope and spirit of the invention.

It should be appreciated by those skilled in the art that various modifications and variations can be made to the embodiments of the invention illustrated and described herein without departing from the scope and spirit of the invention.

What is claimed is:

1. An electronic dispenser for-dispensing measured sheets from a roll of web material, comprising:

a housing, and a roll carrier disposed in said housing to rotationally support the roll of web material, said housing further comprising a dispensing slot defined therein through which measured sheets of the web material are dispensed;

an electrically driven feed mechanism disposed in said housing to dispense the sheets of web material therefrom;

an electric motor configured with said feed mechanism, said motor driving said feed mechanism to dispense a measured length of the web material upon activation of said dispenser; and a sensor disposed along a running path of the web material, said sensor comprising means for detecting a parameter that is changed by an initial pull exerted on a tail of the web material and for generating a signal causing said motor to drive said feed mechanism until a measured length of web material that includes the tail of web material has been feed from said dispenser in the form of a measured sheet for subsequent removal by a user, said sensor being in a dormant unpowered mode until said changed parameter is sensed.

2. The dispenser as in claim 1, further comprising a control circuit configured with said motor, said feed mechanism, and said sensor.

3. The dispenser as in claim 2, wherein upon activation of said sensor, said control circuit powers said motor for a time necessary to dispense the predetermined length of web material that includes the initially extending tail of web material.

4. The dispenser as in claim 1, wherein said dispenser is a paper towel dispenser.

5. An electronic dispenser for dispensing measured sheets from a roll of web material, comprising:

a housing, and a roll carrier disposed in said housing to rotationally support the roll of web material, said housing further comprising a dispensing slot defined therein through which measured sheets of the web material are dispensed;

an electrically driven feed mechanism disposed in said housing to dispense the sheets of web material therefrom;

an electric motor configured with said feed mechanism, said motor driving said feed mechanism to dispense a measured length of the web material upon activation of said dispenser;

a sensor disposed along a running path of the web material, said sensor configured to detect a parameter that is changed by a force exerted on a tail of the web material, said sensor being in a dormant unpowered mode until said changed parameter is sensed;

wherein said dispenser is activated to automatically dispense a measured length of the web material by a user pulling on a tail of the web material extending from said dispensing slot, said sensor detecting said initial pull and generating a signal causing said motor to drive said feed mechanism until the measured length of web material has been fed from said dispenser; and wherein said sensor is disposed against the web material at a location within said housing, said sensor detecting a deviation in the running path of the web material caused by a user pulling on the tail end of the material.

6. The dispenser as in claim 5, wherein said sensor comprises a contact surface that is depressed by the web material upon the user pulling on the tail end of the material.

7. An electronic dispenser for dispensing measured sheets from a roll of web material, comprising:

a housing, and a roll carrier disposed in said housing to rotationally support the roll of web material, said housing further comprising a dispensing slot defined therein through which measured sheets of the web material are dispensed;

an electrically driven feed mechanism disposed in said housing to dispense the sheets of web material therefrom;

an electric motor configured with said feed mechanism, said motor driving said feed mechanism to dispense a measured length of the web material upon activation of said dispenser;

a sensor disposed along a running path of the web material, said sensor configured to detect a parameter that is changed by a force exerted on a tail of the web material, said sensor being in a dormant unpowered mode until said changed parameter is sensed;

wherein said dispenser is activated to automatically dispense a measured length of the web material by a user pulling on a tail of the web material extending from said dispensing slot, said sensor detecting said initial pull and generating a signal causing said motor to drive said feed mechanism until the measured length of web material has been fed from said dispenser; and further comprising at least one roll mounted within said housing that is caused to rotate upon the web material being pulled from said dispenser, said sensor comprising a motion sensor disposed to detect motion of said roll.

8. The dispenser as in claim 7, wherein said feed mechanism comprises a pair of feed rollers defining a nip therebetween through which the web material passes, one of said feed rollers being a driven roller configured with said motor, and the other said feed roller being a pressure roller disposed against said driven roller, said sensor disposed to detect rotational movement of at least one of said feed rollers.

9. An electronic dispenser for dispensing measured sheets from a roll of web material, comprising:

a housing, and a roll carrier disposed in said housing to rotationally support the roll of web material, said housing further comprising a dispensing slot defined therein through which measured sheets of the web material are dispensed;

an electrically driven feed mechanism disposed in said housing to dispense the sheets of web material therefrom;

an electric motor configured with said feed mechanism, said motor driving said feed mechanism to dispense a measured length of the web material upon activation of said dispenser;

a sensor disposed along a running path of the web material, said sensor configured to detect a parameter that is changed by a force exerted on a tail of the web material, said sensor being in a dormant unpowered mode until said changed parameter is sensed;

wherein said dispenser is activated to automatically dispense a measured length of the web material by a user pulling on a tail of the web material extending from said dispensing slot, said sensor detecting said initial pull and generating a signal causing said motor to drive said feed mechanism until the measured length of web material has been fed from said dispenser; and further comprising a web cutting device configured for the user to sever the measured length of web material into an individual sheet.

10. The dispenser as in claim 9, further comprising a cutting sensor disposed to detect a web cutting operation and to generate a control signal causing said feed mechanism to subsequently dispense a second measured length of the web material from the dispensing slot to define a tail for the next user.

11. The dispenser as in claim 10, wherein said web cutting device comprises a tear bar disposed proximate to said dispensing slot, whereby the user severs the measured length of web material by pulling the material against said tear bar.

12. The dispenser as in claim 11, wherein said cutting sensor comprises a tear bar sensor disposed to detect movement of said tear bar upon the user severing the web material.

13. An electronic dispenser for dispensing measured sheets from a roll of web material, comprising:

a housing, and a roll carrier disposed in said housing to rotationally support the roll of web material, said housing further comprising a dispensing slot defined therein through which measured sheets of the web material are dispensed;

an electrically driven feed roll disposed in said housing to dispense the sheets of web material therefrom;

an electric motor configured with said feed roll, said motor driving said feed roll to dispense a measured length of the web material upon activation of said dispenser;

a first sensor disposed along a running path of the web material, the web material passing over said sensor, said sensor being deflected by the web material upon a user initially pulling on a tail of the web material extending from the dispensing slot and generating a signal causing said motor and feed roll to automatically dispense a measured length of the web material, said sensor being in a dormant unpowered mode until activated by the user pulling on the tail;

a deflectable tear bar mounted proximate to said dispensing slot;

a tear bar sensor disposed to detect movement of said tear bar upon the user severing the dispensed length of web material against said tear bar, said tear bar sensor generating a signal causing said motor and feed roll to dispense a second measured length of the web material to define the tail for the next user.

* * * * *